United States Patent [19]

Rubin et al.

[11] 4,396,525

[45] Aug. 2, 1983

[54] PHOSPHATE FREE LIQUID SCOURING COMPOSITION

[75] Inventors: Fred K. Rubin, Leonia; David V. Blarcom, West Milford; Daniel J. Fox, Hawthorne, all of N.J.

[73] Assignee: Lever Brothers Company, New York, N.Y.

[21] Appl. No.: 301,715

[22] Filed: Sep. 14, 1981

[51] Int. Cl.[3] ..... C11D 17/08

[52] U.S. Cl. ..... 252/174.25; 252/110; 252/113; 252/174.14; 252/553; 252/546; 252/DIG. 7; 252/DIG. 14

[58] Field of Search ..... 252/DIG. 7, DIG. 14, 252/553, 110, 174.14, 174.18, 174.25, 113, 116, 120, 131, 155, 546

[56] References Cited

U.S. PATENT DOCUMENTS

| | | | |
|---|---|---|---|
| 3,755,559 | 8/1973 | Hewitt | 252/545 |
| 3,840,480 | 10/1974 | Barrat et al. | 252/545 |
| 3,950,417 | 4/1976 | Verdicchio et al. | 252/545 |
| 4,051,056 | 9/1977 | Hartman | 252/99 |
| 4,116,851 | 9/1978 | Rupe et al. | 252/99 |
| 4,122,043 | 10/1978 | Kersnar et al. | 252/275 |
| 4,352,678 | 10/1982 | Jones et al. | 252/528 |

FOREIGN PATENT DOCUMENTS

| | | |
|---|---|---|
| 9942 | 4/1980 | European Pat. Off. . |
| 30986 | 7/1981 | European Pat. Off. . |

*Primary Examiner*—John E. Kittle
*Assistant Examiner*—Hoa Van Le
*Attorney, Agent, or Firm*—Milton L. Honig; James J. Farrell

[57] ABSTRACT

This invention discloses a liquid scouring composition comprising in percent by weight of the composition (a) about 0.5% to about 5% anionic surfactant; (b) about 0.5% to about 5% amphoteric surfactant; (c) about 5% to about 65% abrasive; (d) about 0.1% to about 8% electrolyte; (e) 0% to about 5% other ingredients; and (f) water to make 100%.

7 Claims, No Drawings

PHOSPHATE FREE LIQUID SCOURING COMPOSITION

This invention relates generally to liquid scouring compositions and more particularly to abrasive-containing scouring compositions having coco-amido betaine as an essential component.

Abrasive-containing, liquid scouring cleaners have gained acceptance over the last few years due to their delivery of both cleaning power and convenience without the negative of abrasive damage that comes from using powdered cleansers. In order to adequately suspend the abrasive particles, however, it is necessary to use a combination of surfactants plus an electrolyte to provide structure to the liquid. In proper combination, the surfactants produce a micellar structure which provides the necessary support to suspend particles. In addition to providing support for the abrasives used, the surfactants act as cleaning agents on many of the soils encountered, particularly on softer fatty soils where penetration of the surfactants into the substrate plays an important role in the cleaning process.

Most commercial products use a combination of an anionic surfactant, such as alkylbenzene sulfonate, with a nonionic surfactant such as a diethanolamide or amine oxide. We have found that use of an amphoteric surfactant, namely coco-amido propyl dimethyl betaine, in place of the nonionic, significantly increases the detergency of the product on soft, tacky soils where abrasive action alone is not very effective. We have also discovered that a betaine can be used in combination with an anionic surfactant to produce a stable base for supporting the abrasive particles which are needed to clean difficult, baked or crusted-on soils. The electrolytes required to assist the formation of a suspending structure may be phosphate or nonphosphate salts. The compositions of the present invention are particularly suited to nonphosphate electrolytes in view of the numerous areas in the country where phosphates are not allowed in household products.

There are phosphate-free as well as phosphate-containing liquid scouring cleaners which employ anionic/-nonionic surfactant systems as a basis for their suspending structure. Liquid abrasive cleaner compositions which are based on anionic surfactants and nonionic co-surfactants of the alkanolamine, amine oxide or ethoxylated fatty alcohol type are known. The present invention represents a departure from prior art by utilizing, in place of nonionics, a particular type of amphoteric as co-surfactant to produce a stable, excellently performing scouring cleaner composition. The compositions of the present invention provide improved soil removal characteristics over corresponding compositions in which the co-surfactant is a nonionic. The use of the amphoteric coco-amido betaine also promotes easy rinsing from surfaces of the abrasive bearing composition, a feature not usually found in commercial compositions.

U.S. Pat. No. 4,129,527 discloses an abrasive containing liquid using an anionic surfactant along with an electrolyte and lauryl dimethyl amine oxide to provide both cleaning action and support for the abrasive particles. This patent very specifically limits itself to amine oxide as a co-surfactant with the listed anionic surfactants.

U.S. Pat. No. 3,281,367 describes a surfactant system using an anionic surfactant such as linear alkyl benzene sulfonate along with soap and a nonionic surfactant, specifically a fatty acid alkanolamide wherein the fatty acid contains from about 8 to about 18 carbon atoms. U.S. Pat. Nos. 3,912,662, 3,966,432, 3,210,285, 4,051,056, 4,122,043 and 4,158,644 describe surfactant systems capable of supporting abrasive particles while providing some degree of cleaning.

None of the patents, however, teaches or suggests a combination of surfactants such as we have found to provide not only suspending action for the abrasive particles used, but also improved cleaning power over the types of surfactants listed in the above patents.

It is, therefore, an object of the present invention to substantially overcome the limitations and disadvantages of the prior art.

It is another object of the present invention to provide a coco-amido betaine containing liquid scouring composition with improved cleaning and rinsing properties.

It is a further object of the present invention to provide a non-phosphate containing liquid scouring composition which is stable without the necessity of colloid forming agents.

Other objects and advantages will appear as the description proceeds.

The attainment of these and other objects is achieved by this invention which includes a liquid scouring composition consisting essentially of in percent weight of the composition: (a) about 0.5% to about 5% anionic surfactant; (b) about 0.5% to about 5% amphoteric surfactant; (c) about 5% to about 65% abrasive; (d) about 0.1% to about 8% electrolyte; (e) 0% to about 5% other ingredients; and (f) water to make 100%.

The abrasive-containing, liquid hard-surface cleaning compositions of this invention contain the following compounds either as essential components or as optional ingredients: anionic surfactants, amphoteric surfactants, electrolytes, water insoluble abrasive materials, various colloid forming clays, perfume, coloring agents, ammonia and bacteriostats. Each of these components, both essential and optional, are now discussed in greater detail.

ANIONICS

Comprise soap and synthetic surfactants. Sodium or potassium soaps derived from a blend of tallow/coco fatty acids are useful as one of the anionic surfactants. The fatty acids used may be derived from sources other than tallow or coconut oil, for example, palm oil, peanut oil, etc. The soap level in our composition may vary from 0% to 1.0%, basis formula weight, with preferred range from 0.4 to 0.75%. The synthetic anionic surfactant is one selected from alkyl aryl sulfonates containing 8 to 18 carbon atoms in the alkyl group in a straight or branched chain, alkyl sulfonates and acylamino alkane sulfonates and mixtures thereof. The synthetic anionic surfactant in our compositions may vary from 0.5% to about 5.0% basis formula weight with preferred range of about 1.5 to about 2.5% with the alkyl aryl sulfonates being the preferred form.

CO-SURFACTANT

As stated before, a co-surfactant is needed to form the micellar structure which supports the abrasive particles present in the composition. This component is an alkylamido betaine, preferably a coco-amido betaine, and most preferably coco-amido propyl dimethyl betaine such as Lonzaine C from Lonza Corporation, Fairlawn, N.J. or Mirataine CB from the Miranol Chemical Company, Irvington, N.J. This surfactant has the following formula:

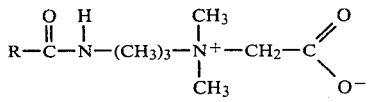

where R is an alkyl group preferably having a chain length distribution typical of coconut oil.

The amido-betaine in the compositions may vary from 0.5 to about 5.0% basis formula weight with the preferred range of about 1.5% to about 3.0%.

In addition to providing structure to the liquid to support the abrasive particles, the surfactants also perform another, more conventional role of aiding in the cleaning of tacky, sticky soils which are not entirely removed by the abrasive. It has been found that the use of an amphoteric amido betaine not only provides good structuring ability, but also shows a marked improvement over other surfactants commonly used to clean tenacious fatty soils. The soil tests to evaluate cleaning properties are described infra.

ELECTROLYTES

The electrolytes in the instant compositions consist of one or more salts from the group comprising alkali metal sulfates, alkali metal carbonates or bicarbonates, alkali metal halides, silicates and citrates as well as alkali metal and alkaline earth salts of ethylene diamine tetracetic acid, alkali metal nitrates and mixtures thereof. The electrolytes or mixtures thereof may vary from 0.1% to about 8.0% basis formula weight with the preferred range of about 0.5% to about 2.0% with the alkali metal carbonates being the preferred form.

ABRASIVES

The solid abrasives of the instant compositions are represented by finely divided substantially water-insoluble abrasive materials selected from the group consisting of calcite, dolomite, feldspar, silica flour, quartz, pumice, polishing clays, perlite, diatomite, alumina and mixtures thereof. The substantially water insoluble abrasive should be of a particle size such that essentially the whole of the material passes a sieve with apertures of 104 microns and at least 80% passes a sieve with aperture of 53 microns. The abrasive material may constitute from about 5% to about 65% of the formulation, basis formula weight, with the preferred range being from about 35% to about 60% and with calcite as the preferred form.

OPTIONAL INGREDIENTS

Other ingredients in an amount ranging from 0–5% such as perfume, coloring agents, ammonia, germicides and other adjuvants may also be incorporated provided that their nature and amount is not such as to destroy the stability of the composition. Various colloid forming agent such as attapulgite clay may also be added if increased product viscosity and stability at extreme temperatures are desired.

The compositions of the present invention may also optionally include a bleaching agent. Any suitable bleaching agent which yields active chlorine in aqueous solution may be employed. Some examples of such bleaching agents are alkali metal and alkaline earth metal hypochlorites, hypochlorite addition products, chloramines, chlorimines, chloramides, chlorimides and chlorocyanurates. Coated or encapsulated bleaching agents which are resistant to surfactants in aqueous media are the preferred forms of bleaching agents for use in the compositions of the present invention.

COMPOSITION PREPARATION

The liquid, abrasive-containing hard surface cleaners as described herein can be prepared in the following manner: The water is heated to about 140° to 160° F. at which point the electrolyte is added and dissolved. The abrasive material is then added with continuous stirring sufficient to keep the particles suspended. Surfactant materials are added at this point and the stirring of the mixture is slowed as it now is sufficiently viscous to keep the particles suspended. Temperature is then allowed to drop to 100° F. at which point any additional components, such as perfume and adjuvants, are added. Temperature is then allowed to drop to room temperature, agitation is discontinued and the product preparation is completed.

TEST SOIL COMPOSITION

This soil is composed of a 2:1 weight ratio of vegetable shortening and an all-purpose, white wheat flour. The soil mixture is screen printed onto an aluminum tile which provides a thin, uniform level of soil. The soil is then heated in an oven at about 350° F. for about ½ hour which provides a sticky, tacky soil which cannot be removed too easily with water and sponge alone as the soil tends to smear rather than be uniformly removed. It has been found that this soil provides good discrimination between surfactant systems and predicts consumer reaction to the product's cleaning ability.

The following examples, without limiting the scope thereof, illustrate the invention.

EXAMPLE 1

This example illustrates the use of a coco-amido betaine in a nonphosphate, liquid scouring cleanser formulation.

| Component | % weight |
|---|---|
| Sodium carbonate | 1.0 |
| Calcium carbonate | 54.0 |
| Sodium alkylbenzene sulfonate | 2.0 |
| Soap chips | 0.64 |
| Coco-amido betaine | 2.5 |
| Perfume | 0.2–0.3 |
| Water (distilled) | to 100.0% |

EXAMPLE 2

The composition of Example 2 is the same as that of Example 1 except that 0.75% attapulgite clay was added as an optional component.

The formulation of Example 2 was tested for cleaning efficiency using the fat/flour soil as described, supra. The test was also run on other experimental products of the same composition except for the difference in co-surfactant used. Co-surfactants tested were amine oxide and lauric/myristic diethanolamide. The cleaning efficiency on this soil was measured by the following formula:

% cleaning efficiency =

-continued $$\frac{\text{\% area cleaned by experimental product}}{\text{\% area cleaned by standard product}} \times 100$$

where the % area cleaned is determined visually by an experienced operator and said standard product used for comparison is a commercially produced phosphate containing hard surface cleaner of the following composition:

| Commercial Product Used As Standard | Weight % |
|---|---|
| Sodium alkyl benzene sulfonate | 2.0 |
| Soap chips | .64 |
| Lauric/myristic diethanolamide | 2.40 |
| Calcium carbonate | 48.0 |
| Sodium tripolyphosphate | 4.76 |
| Attapulgite clay | .50 |
| Perfume | .3 |
| Water | to 100% |

A commercial product with a similar composition but made with lauric dimethyl amine oxide was also tested for comparison.

The cleaning efficiencies of various products are set forth in Table 1.

TABLE 1

| Co-surfactant Used In The Product | % Cleaning Efficiency |
|---|---|
| Coco-amido betaine (Example 2) | 85% |
| Lauric/myristic diethanolamide (Commercial Product) | 58% |
| Lauric dimethyl amine oxide (Commercial Product) | 39% |

The data in Table 1 clearly show the superiority of the composition of the present invention inasmuch as the improvement in the cleaning efficiency is a direct consequence of the use of coco-amido betaine as the co-surfactant according to the teaching of the present invention.

In addition to the improvement in cleaning efficiency, the use of a coco-amide betaine as a co-surfactant also results in improvement in rinsing when compared with products made with other surfactants. Rinsing efficiency is tested by spreading a measured amount of product on a non-porous surface, such as a glass plate, and drawing a damp sponge across the product. The amount of residue left behind on the glass plate is then judged by experienced operators and rated against a commercially available product. A scale of 0 indicates no residue. A scale of 1 indicates trace amount of residue. A scale of 2 indicates very slight amount of residue. A scale of 3 indicates slight amount of residue. A scale of 4 indicates moderate amount of residue. A scale of 5 indicates considerable amount of residue and a scale of 6 indicates heavy residue.

The standard products used for comparison were the same as described herein supra. Table 2 shows the results of the rinse test.

TABLE 2

| Co-surfactant Used | Rinsing Efficiency |
|---|---|
| Coco-amido betaine | 3.0 |
| Lauric dimethyl amine oxide | 4.5 |
| Lauric/myristic diethanolamide | 5.5 |

The results in Table 2 again show the superiority of the composition of the present invention wherein the improvement in rinsing efficiency is a direct consequence of the use of a coco-amido betaine as the co-surfactant in the product according to the teaching of the present invention.

EXAMPLES 3–5

The following examples, using different levels of coco-amido betaine, were tested for the stability of the resulting products under severe conditions of heat (125° F.) and cold (0°–70° F. temperature cycling).

| Component | % weight Example 3 | Example 4 | Example 5 |
|---|---|---|---|
| Water (distilled) | 39.9 | 39.6 | 38.9 |
| Sodium carbonate | 1.0 | 1.0 | 1.0 |
| Attapulgite clay | .75 | .75 | .75 |
| Calcium carbonate | 54.0 | 54.0 | 54.0 |
| Sodium alkylbenzene sulfonate | 2.0 | 2.0 | 2.0 |
| Soap chips | .64 | .64 | .64 |
| Coco-amido betaine | 1.5 | 1.75 | 2.50 |
| Perfume | .2 | .2 | .2 |

Stability of these compositions after one month of storage at different temperatures is shown in Table 3.

TABLE 3

| | 125° F. | 105° F. | Room Temp. | 50° F. | 35° F. | Six Cycles** (0/70° F. cycle) |
|---|---|---|---|---|---|---|
| Example 3 | S* | S | S | S | S | S |
| Example 4 | S | S | S | S | S | S |
| Example 5 | S | S | S | S | S | S |

*S = stable, no liquid or abrasive separation.

**= Each cycle consists of a 48 hour period wherein the temperature gradually increases from 0° F. to 70° F. within the first half of the cycle (24 hours) and then gradually decreases from 70° F. back to 0° F. during the second half (24 hours) of the cycle.

The results in Table 3 show that the coco-amido betaine-containing product is stable even at low levels of the betaine and under wide ranging temperature conditions.

It is understood that the examples and embodiments described herein are for illustrative purposes only and that various modifications or changes in the light thereof will be suggested to persons skilled in the art and are to be included within the spirit and purview of this application and the scope of the appended claims. All percentages in these formulations and examples are by weight unless specified otherwise.

What is claimed is:

1. A liquid scouring composition consisting essentially of in percent by weight of the composition:

(a) about 0.5% to about 5% anionic surfactant;

(b) about 0.5% to about 5% alkyl-amido betaine surfactant;

(c) about 5% to about 65% abrasive;

(d) about 0.1% to about 8% electrolyte;

(e) 0% to about 5% other ingredients; and (f) water to make 100%.

2. A scouring composition according to claim 1 wherein said anionic surfactant is selected from the group consisting of soaps, alkyl aryl sulfonates having 8 to 18 carbon atoms in the alkyl group in a straight or branched chain, alkyl sulfonates, acylamino alkane sulfonates and mixtures thereof.

3. A scouring composition according to claim 1 wherein said alkyl-amido betaine is a coco-amido betaine.

4. A scouring composition according to claim 3 wherein said coco-amido betaine is coco-amido propyl dimethyl betaine.

5. A scouring composition according to claim 1 wherein said abrasive is selected from the group consisting of calcite, dolomite, feldspar, silica flour, quartz, pumice, polishing clays, perlite, diatomite, alumina and mixtures thereof.

6. A scouring composition according to claim 1 wherein said electrolyte is selected from the group consisting of alkali metal sulfates, carbonates, bicarbonates, halides, silicates, citrates, nitrates, alkaline earth salts of ethylene diamine tetraacetic acid, carboxymethyloxysuccinate, carboxymethyloxytartronate and mixtures thereof.

7. A scouring composition according to claim 1 wherein said other ingredient is selected from the group consisting of bleaching agents, perfumes, coloring agents, ammonia, germicides, colloid forming agents, and mixtures thereof.

* * * * *